US011350781B2

(12) United States Patent
Tumlin et al.

(10) Patent No.: US 11,350,781 B2
(45) Date of Patent: Jun. 7, 2022

(54) FLOORING EDGE TOOLS

(71) Applicant: COLUMBIA INSURANCE COMPANY, Omaha, NE (US)

(72) Inventors: Daniel Tumlin, Cartersville, GA (US); William Drew Pierce, Cartersville, GA (US); Chavis Williams, Omaha, NE (US); John Moore, Omaha, NE (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 17/320,777

(22) Filed: May 14, 2021

(65) Prior Publication Data

US 2021/0353086 A1 Nov. 18, 2021

Related U.S. Application Data

(60) Provisional application No. 63/025,675, filed on May 15, 2020.

(51) Int. Cl.

| | |
|---|---|
| ***A47G 27/02*** | (2006.01) |
| ***A47G 27/04*** | (2006.01) |
| ***E04F 15/02*** | (2006.01) |

(52) U.S. Cl.

CPC ..... *A47G 27/0268* (2013.01); *A47G 27/0443* (2013.01); *A47G 27/0487* (2013.01); *E04F 15/02027* (2013.01); *E04F 15/02155* (2013.01); *E04F 2290/04* (2013.01)

(58) Field of Classification Search

CPC ..... A47G 27/0268; A47G 27/0443; A47G 27/0487; E04F 15/02027; E04F 15/02155; E04F 2290/04

USPC ..... 7/103

See application file for complete search history.

(56) References Cited

U.S. PATENT DOCUMENTS

| | | | | |
|---|---|---|---|---|
| 2,576,621 | A | 11/1951 | McBride et al. | |
| 2,720,245 | A | 10/1955 | Reinhard | |
| 3,413,176 | A | 11/1968 | Port et al. | |
| 4,749,433 | A | 6/1988 | Johnston et al. | |
| 5,333,401 | A | 8/1994 | Klein | |
| 9,085,848 | B2 * | 7/2015 | Crain | D06F 75/08 |
| 11,203,878 | B2 * | 12/2021 | O'Connor | E04F 21/22 |
| 2009/0277589 | A1 * | 11/2009 | Simpson | A47G 27/0443 156/368 |
| 2014/0272278 | A1 | 9/2014 | Malpass et al. | |

OTHER PUBLICATIONS

PCT Application No. PCT/US2021/032441, International Search Report and Written Opinion dated Sep. 28, 2021, 8 pages.

* cited by examiner

*Primary Examiner* — Hadi Shakeri

(74) *Attorney, Agent, or Firm* — Lathrop GPM LLP; Laura A. Labeots

(57) ABSTRACT

A hand-held or table-mounted tool for adhering a flooring edge finish to a flooring edge. The hand-held tool includes a main body, which can include a handle, a base, and a bi-level soleplate, which is heated during application to adhere a flooring edge finish to a flooring edge. The soleplate of the tool can be made of polymer, carbon, metal, ceramic, glass, or a mixture thereof.

12 Claims, 9 Drawing Sheets

70

72

Position a flooring edge finish along a bottom and/or an edge of a flooring.

74

Use a flooring edge tool to apply heat, pressure, or a combination thereof to the flooring edge finish to adhere to the flooring.

76

Optionally, apply more heat, pressure, or a combination thereof to the flooring edge finish with heat gun.

FIG. 7

130

132

Feed a flooring edge finish into a feed section of a table-mounted flooring edge tool.

134

Feed the flooring along the feed section.

136

Use an attachment section of a table-mounted flooring edge tool to apply heat, pressure, or a combination thereof to the flooring edge finish.

138

Optionally, apply more heat, pressure, or a combination thereof to the flooring edge finish with heat gun.

FIG. 13

FLOORING EDGE TOOLS

CROSS-REFERENCE TO RELATED APPLICATION

This application claims the benefit of priority U.S. Provisional Application No. 63/025,675, filed on May 15, 2020, the entirety of which is incorporated herein by reference.

BACKGROUND

Carpeting and hard surface flooring can function as beautiful additions to any home or business. The durability and esthetics of the finishing of many of these products need improvement, however. Generally, carpets that are not fitted to a wall have an exposed edge that should be bound to prevent fraying of the carpet fibers and to prevent damage to the carpet backing underneath. Similarly, hard surface flooring can have a ragged and uneven edge, which can be damaged with wear.

Current methods of finishing flooring edges are ineffectual, often resulting in unattractive products. One method of preventing flooring edge fraying involves stapling the raw edge of the flooring with large metal staples, which is both unsightly and hazardous, as the staples inevitably detach with wear. Another method involves stitching the end of a carpet with heavy yarn, which stitching is inelegant and unravels with time. Furthermore, stitching requires expensive, heavy-duty sewing machines. Still another method pertains to gluing the edge of the flooring, which application and outcome is messy and displeasing to the eye. In addition, these methods can be troublesome because bulky, heavy equipment must be used for the installation and flooring edge finishing. Thus, there exists a need for a compact, easy-to-use, hand-held tool for finishing the edge of a carpet or hard surface flooring at an installation site and for an in-line system for finishing an edge in a factory setting, which the present disclosure provides.

BRIEF SUMMARY

The present application is directed to a hand-held or table-mounted flooring edge tool for applying a flooring edge finish, which provides the look of a factory or custom finish to the edge of a carpet or a hard surface flooring. Upon installation, the raw edge of the flooring is securely and discreetly hidden by the flooring edge finish. The flooring edge finish includes a longitudinal section coated with an adhesive and a hinge. The flooring edge tool is structured so as to be able to apply heat, pressure, or a combination thereof, to the bottom and side sections of the flooring edge finish simultaneously.

The flooring edge tool for applying a flooring edge finish to a flooring surface includes a main body having a handle for grasping that includes a base having a first width $W_1$; a bi-level soleplate coplanar with and coupled to the base, the bi-level soleplate comprising at least two sections, wherein a first section of the soleplate has a first thickness $T_1$, a length L, and a second width $W_2$; and a second section of the soleplate has a second thickness $T_2$, the length L, and a third width $W_3$, wherein $T_2$ is greater than $T_1$, and $W_3$ is approximately equal to $W_1-W_2$; and a heating element within the main body for heating the bi-level soleplate.

Another embodiment is directed to a method of applying a flooring edge finish to flooring using a flooring edge tool, which includes positioning a flooring edge finish at the edge of a flooring; and applying heat, pressure or a combination thereof to the flooring edge finish using the flooring edge tool having a bi-level soleplate, wherein the flooring edge finish is adhered to a bottom surface of the flooring and an edge of the flooring simultaneously.

Yet another embodiment is a heating table for applying and adhering a flooring edge finish to flooring, said table comprising a feed section including a first lower plate having a length and width; an upper plate positioned along both the length of the first lower plate and a portion of the width; and a first edge plate positioned along the length of the first lower plate and adjacent to the upper plate, wherein the upper plate and the first edge plate are separated by a gap; wherein the flooring edge finish is folded while moving through the feed section, such that a first longitudinal section of the finishing strip is positioned between the first lower and upper plates, and a second longitudinal section of the finishing strip is positioned between the upper plate and the first edge plate; and an attachment section abutting the feed section comprising a second lower plate; a second edge plate; and one or more heating elements for heating the second lower plate and the second edge plate to adhere the flooring edge finish to the bottom and edge surfaces of the flooring simultaneously.

Still another embodiment pertains to a method of applying a flooring edge finish to flooring using a table-mounted flooring edge tool comprising a feed section and an attachment section, the method comprising feeding a flooring edge finish into the feed section so that the flooring edge finish contacts the edge, bottom, or both edge and bottom of the flooring; feeding the flooring along the feed section so that a bottom and side of the flooring is adjacent to the flooring edge finish when leaving the feed section and entering the attachment section; and applying heat, pressure, or a combination thereof to the flooring edge finish using a heating element coupled to the attachment section, wherein the flooring edge finish is adhered to a bottom surface of the flooring and an edge of the flooring simultaneously.

The flooring edge finishing tool of this application has several benefits and advantages. One benefit is that the hand-held tool provides an uncomplicated and efficient method of on-site flooring edge finishing. A second benefit is that the hand-held tool is lightweight and compact making it easy to handle and to transport. A third benefit is the ability to simultaneously adhere a finishing strip to two surfaces (bottom and side) of a flooring edge with the unique biplanar soleplate. A fourth benefit is that the heating table can finish the flooring edge with a flooring edge finish as an in-line automated process.

BRIEF DESCRIPTION OF THE DRAWINGS

FIG. 7 is a flowchart illustrating a method of applying a flooring edge finish to flooring using a hand-held flooring edge tool.

FIG. 13 is a flowchart illustrating a method of applying a flooring edge finish to flooring using a table-mounted flooring edge tool.

DETAILED DESCRIPTION OF EXEMPLARY EMBODIMENTS

Figure 1:
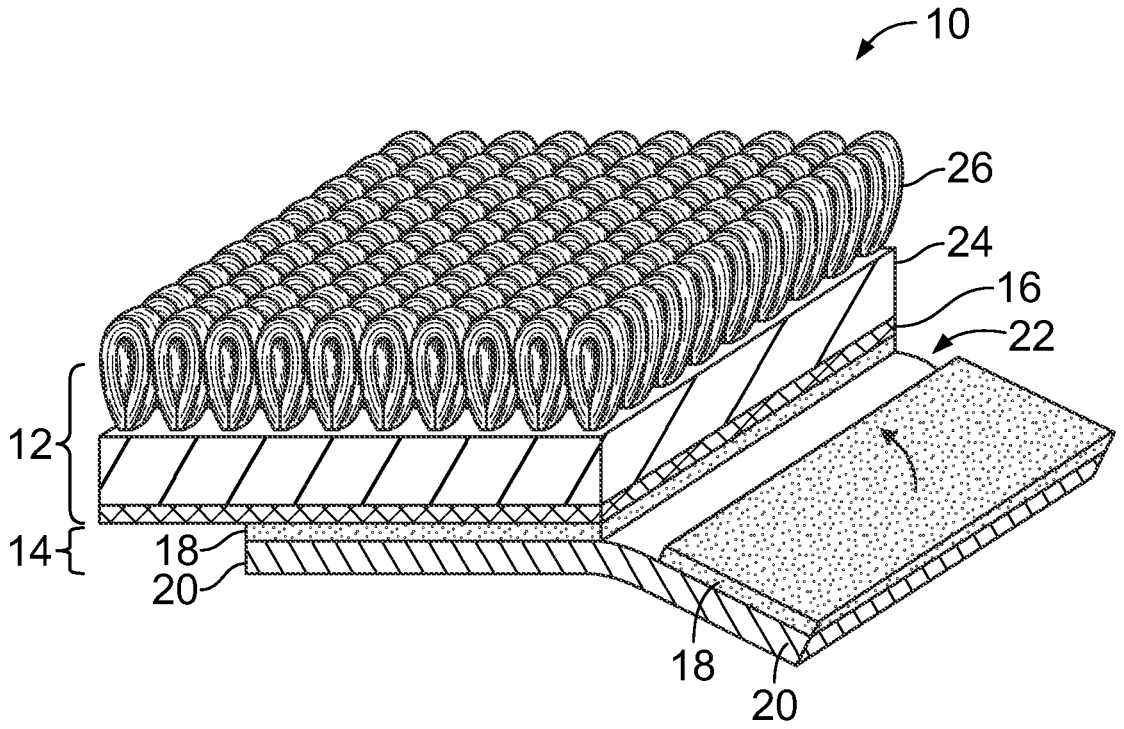
FIG. 1 is a perspective view of a portion of a carpet and a flooring edge finish before adhesion of the flooring edge finish to the carpet's raw edge.
Figure 2:
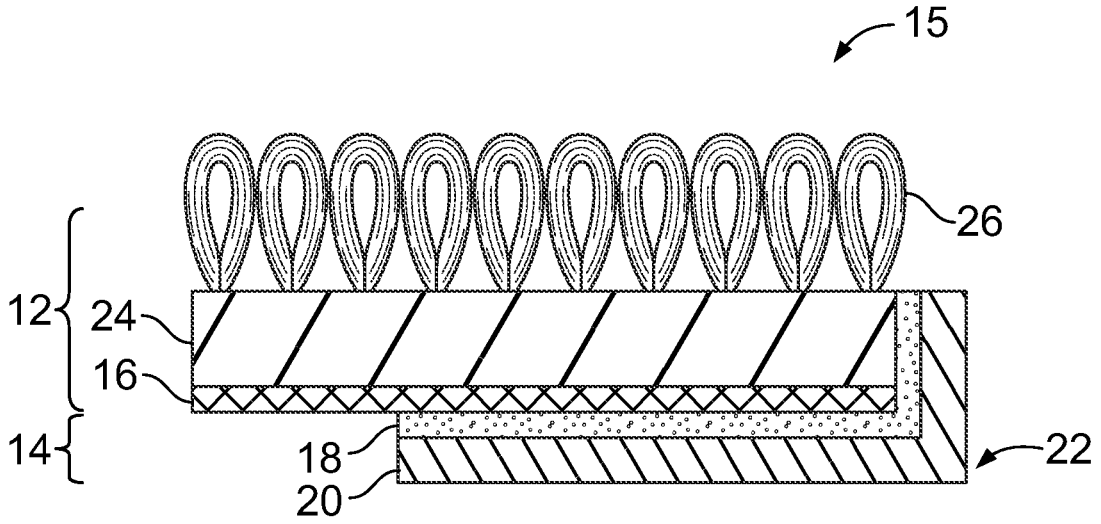
FIG. 2 is a side view of a portion of the carpet and flooring edge finish after adhesion of the flooring edge finish to the carpet's raw edge.

FIG. 1 shows an embodiment of an unbound assembly 10 of a carpet 12 and a flooring edge finish 14. Carpet 12 is depicted as a representative flooring; however, any type of flooring can be used, including a carpet, a hard surface flooring, a luxury vinyl tile, a resilient vinyl flooring, a laminate flooring, or a mixture thereof. Carpet 12 has fibers 26 embedded into carpet backing 24. Carpet pad 16, which is optional, can be included underneath carpet backing 24. Flooring edge finish 14 includes a longitudinal section 20 including a hinge 22. The longitudinal section 20 has an adhesive 18 on a top surface. Hinge 22 has a gap or an absence of the adhesive. Flooring edge finish 14 is upwardly foldable along the hinge 22 to bind, protect, and conceal an edge of a flooring as shown in FIG. 2. Although flooring edge finish 14 is shown in contact with pad 16, this is for purposes of illustrating a positioning of flooring edge finish 14 and does not indicate that the flooring edge finish has been partially adhered to carpet 12.

FIG. 2 shows a side view 15 of carpet 12 and flooring edge finish 14 after flooring edge finish 14 has been adhered to a carpet 12. As in FIG. 1, carpet 12 has fibers 26 embedded into carpet backing 24 and an optional carpet pad 16 underneath the carpet backing 24. Flooring edge finish 14 has been folded upward approximately 90 degrees along the hinge 22 so that the adhesive 18 on longitudinal section 20 contacts carpet pad 16 and carpet backing 24. Flooring edge finish 14 binds and covers the carpet 12 bottom surface and edge.

In one embodiment, hinge 22 can include an approximately 90-degree bend in the flooring edge finish 14 along a bottom section of the edge of the flooring after binding of the longitudinal section 20 to an edge of the flooring. Hinge 22 can also comprise a bend of about 20-170 degrees after binding to the flooring edge. Hinge 22 can also comprise multiple hinges or multiple gaps having little or no adhesive. Further, hinge 22 can form an arcuate bend.

Application of flooring edge finish 14 can be accomplished by heating longitudinal section 20 containing the adhesive 18 with flooring edge tool. The tool can be hand-held, or table-mounted. In one embodiment, the hand-held tool is used to heat the flooring edge finish 14 with pressure against the flooring to provide adherence of the flooring edge finish. In a continuous process where the flooring edge tool is table-mounted, the flooring edge finish 14 can be fed parallel to the flooring, which would properly position the longitudinal section 20 of the flooring edge finish alongside the bottom and side edges of the flooring. Once positioned, flooring edge finish 14 could be heated while traveling with the flooring through the machinery of the continuous process.

Figure 3:
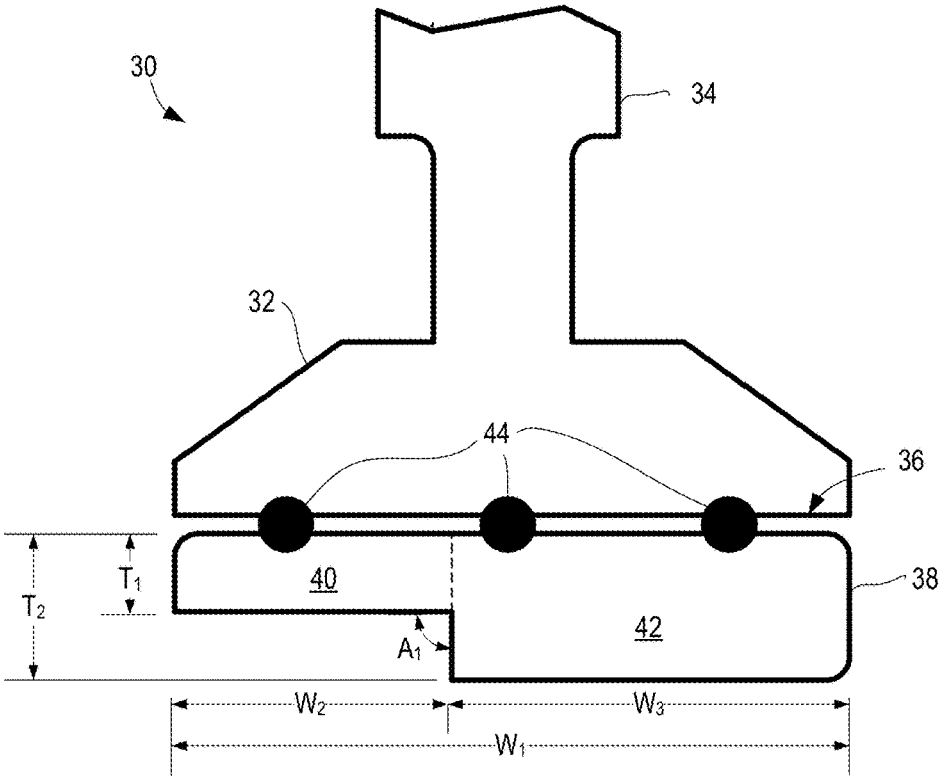
FIG. 3 is an end view of a hand-held flooring edge tool.

FIG. 3 is an end view of a hand-held flooring edge tool 30. A main body 32 of the tool includes an upper extension 34, which can incorporate a handle or grasping surface (not shown). Main body 32 also includes a base 36 having a first width $W_1$ of about 0.2-12 inches, and a length L of about 4-12 inches. In embodiments, length L would extend in a generally perpendicular direction from the end of base 36. A bi-level soleplate 38 is co-planar with and coupled to base 36. Bi-level soleplate 38 includes a first section 40 having a first thickness $T_1$ of about 0.1-1 inches, length L, and a second width $W_2$ of about 0.1-6 inches, wherein the second width $W_2$ is less than the first width $W_1$. The second section of the soleplate 42 has a second thickness $T_2$ of about 0.2-6 inches, length L and a third width $W_3$ of about 0.1-6 inches, wherein $T_2$ is greater than $T_1$ and $W_3$ is approximately equal to $W_1-W_2$. First section 40 and second section 42 meet to form an angle $A_1$. In embodiments, angle $A_1$ is approximately 65-85 degrees. In another embodiment, angle $A_1$ is approximately 90 degrees.

One or more heating elements 44 are incorporated in main body 32 of the hand-held flooring edge tool in a position that brings them into contact with bi-level soleplate 38 for adhering a flooring edge finish 14 to flooring. Main body 32 also incorporates circuitry for controlling heating elements 44 and other components of hand-held flooring edge tool 30. While shown in mutual physical contact between the base 36 and bi-level soleplate 38, in an alternative embodiment, the heating elements 44 are embedded within the base 36 and are in thermal communication with the bi-level soleplate 38. The second lower plate and the second edge plate are capable of being heated to a temperature of approximately 200-500 degrees F. The flooring edge tool can adhere the flooring edge finish to the bottom and the edge of the flooring simultaneously.

Figure 4:
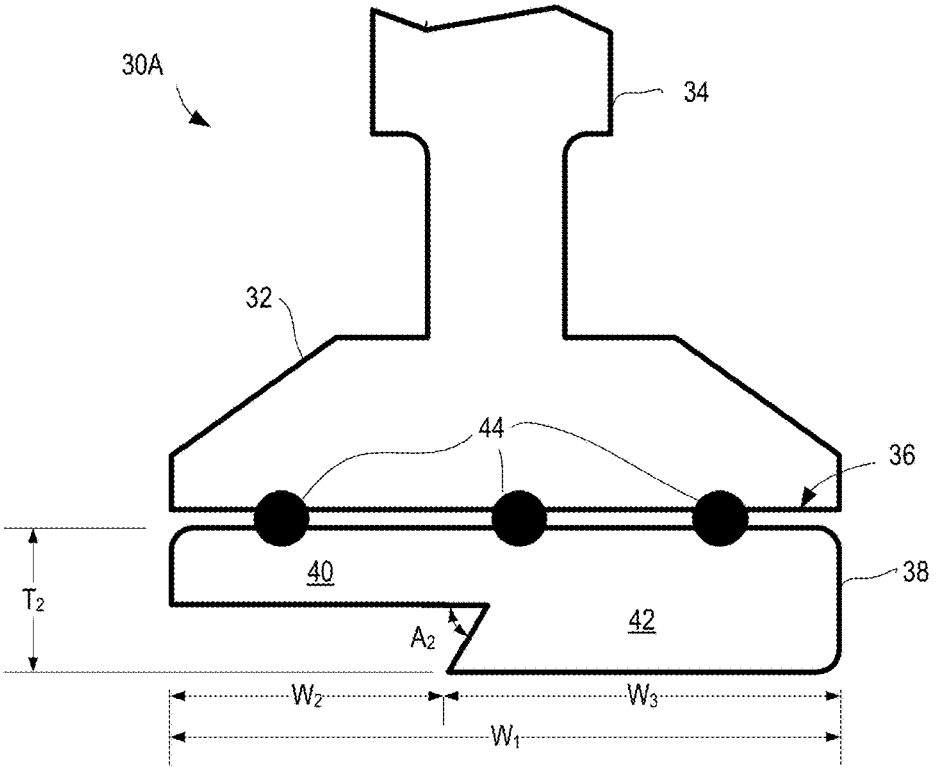
FIG. 4 is an end view of an alternative hand-held flooring edge tool.

FIG. 4 is an end view of hand-held flooring edge tool 30A. In embodiments, flooring edge tool 30A is generally the same as tool 30 in FIG. 3, except that angle $A_2$ between first section 40 and second section 42 is less than 90 degrees. In embodiments, angle $A_2$ can be between approximately 65 and 85 degrees. Angle $A_2$ can be used in flooring edge tool 30A to cause flooring edge finish 14 to be more firmly attached to the flooring.

Figure 5:
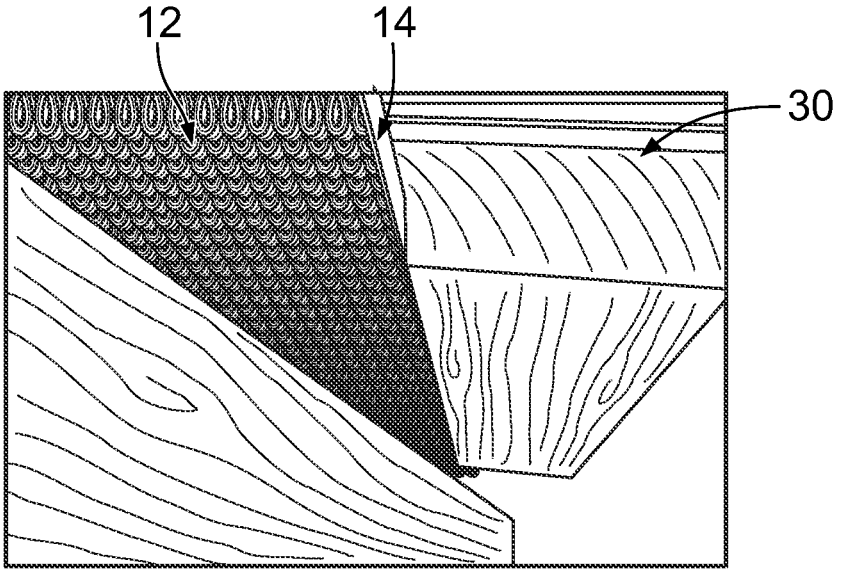
FIG. 5 is a photograph illustrating the hand-held flooring tool of FIG. 3 as it is used to apply a flooring edge finish to a carpet.

FIG. 5 is a photograph illustrating an end view of hand-held flooring tool 30, as it is used to apply a flooring edge finish 14 to a carpet 12. Carpet 12 is placed upside down while flooring edge finish 14 is adhered to the bottom and side of carpet 12 simultaneously.

Figure 6:
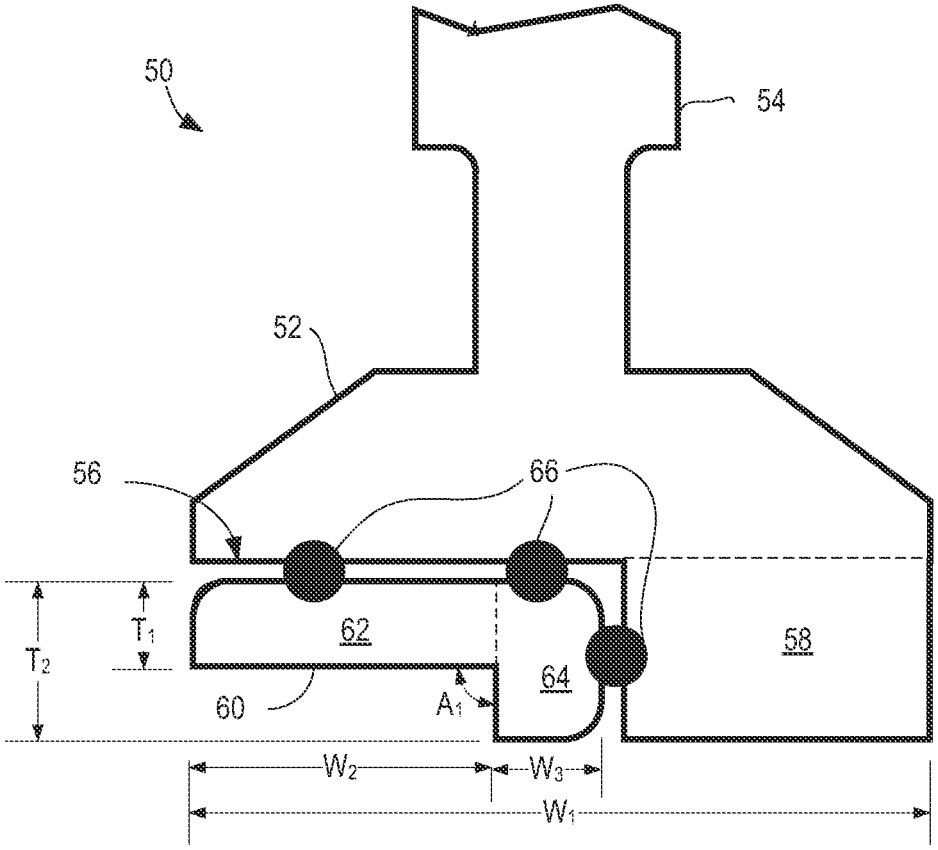
FIG. 6 is an end view of another hand-held flooring edge tool.

FIG. 6 is an end view of a hand-held flooring edge tool 50. A main body 52 includes an upper extension 54, which can incorporate a handle or grasping surface (not shown). Main body 52 of the tool also includes a base 56 having a width $W_1$ and a length L (not shown). In embodiments, length L would extend in a generally perpendicular direction from the end of base 56. Width $W_1$ includes base 56 as well as base projection 58, which extends downward from base 56 to a thickness approximately equal to $T_2$. Base projection 58 extends downward from base 56 along the entire length L of base 56.

A bi-level soleplate 60 is coupled to base 56 and base projection 58. Bi-level soleplate 60 includes a first section 62 having a first thickness $T_1$, length L and a second width $W_2$, wherein the second width $W_2$ is less than the first width $W_1$ and a second section 64 having a second thickness $T_2$, length L and a third width $W_3$, wherein $T_2$ is greater than $T_1$ and $W_3$ is approximately equal to $W_1-W_2$. In another embodiment, the second width $W_2$ is greater than, less than, or equal to the third width $W_3$. First section 62 and second section 64 form an angle $A_1$. In embodiments, angle $A_1$ is approximately 90 degrees, but can be any angle between approximately 65 and 85 degrees. In another embodiment, a total width of the bi-level soleplate ($W_2+W_3$) is less than the width of the base ($W_1$). The soleplate can be made of polymer, carbon, metal, ceramic, glass, or a mixture thereof.

Heating elements 66 are incorporated in main body 52 in a position that brings them into contact with bi-level soleplate 60 for heating a flooring edge finish 14 to flooring. Main body 52 also incorporates circuitry for controlling heating elements 66 and other components of hand-held flooring edge tool 30. While shown in mutual physical contact between the base 56 and bi-level soleplate 60 of the tool, in an alternative embodiment, the heating elements 66 are embedded within the base 56 and are in thermal communication with the bi-level soleplate 60. The heating elements 66 can be spread out randomly or uniformly within the main body 52.

FIG. 7 is a flowchart illustrating a method 70 of applying a flooring edge finish to flooring using the edge finishing tool of FIG. 3, 4 or 6. In embodiments, method 70 includes at least one of steps 72, 74 and 76.

Step 72 includes positioning a flooring edge finish 14 of FIG. 1 along an edge of a flooring. In an example of step 72, flooring edge finish has a longitudinal section including a hinge and the longitudinal section is positioned along a bottom surface of the flooring and along a side of the flooring.

Step 74 includes using a flooring edge tool to apply heat, pressure or a combination thereof to the flooring edge finish. In an example of step 74, a bi-level soleplate 38 of flooring edge tool 30 is positioned against the longitudinal section to simultaneously adhere the flooring edge finish to the bottom and edge surfaces of the flooring simultaneously.

Figure 8:
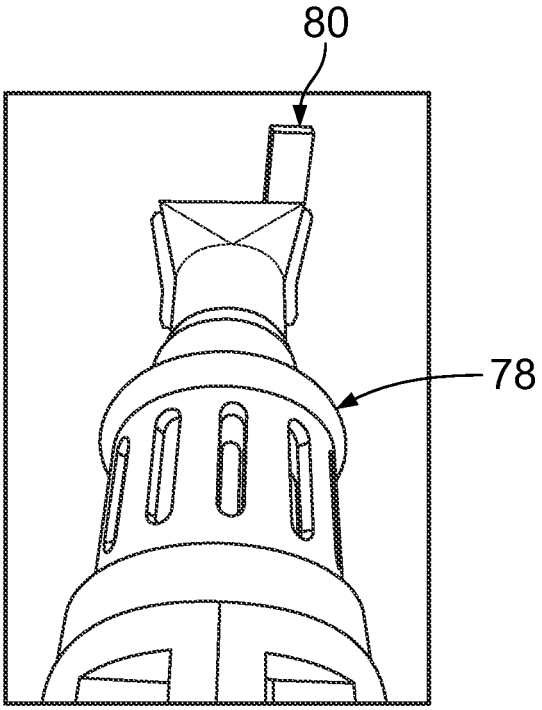
FIG. 8 is a photograph of a heat gun for use in applying a flooring edge finish to a flooring.
Figure 9:
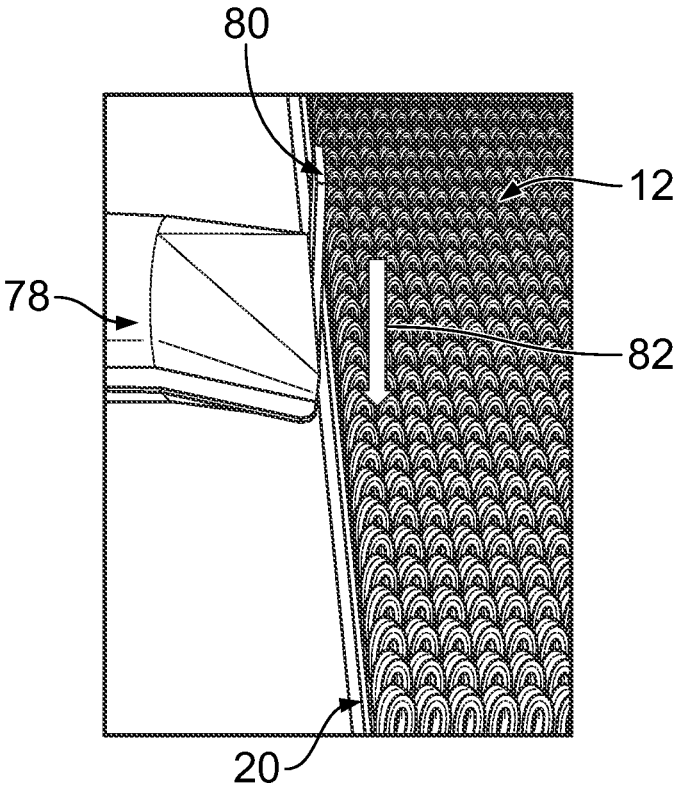
FIG. 9 is a photograph of a heat gun in use.

Step 76, which is optional, includes using a heat gun or other external heat source to apply heat, pressure, or a combination thereof to the flooring edge finish so as to melt the adhesive and adhere to the flooring surfaces. In an example of step 76, a heat gun 78 as shown in FIG. 8 includes a pressure plate 80. As shown in FIG. 9, heat gun 78 optionally can be applied to longitudinal section 20 of flooring edge finish 14 in the direction of arrow 82 to heat longitudinal section 20, then apply pressure using pressure plate 80.

Yet another embodiment is a heating table for applying and adhering a flooring edge finish to flooring, said table comprising a feed section including a first lower plate having a length and width; an upper plate positioned along both the length of the first lower plate and a portion of the width; and a first edge plate positioned along the length of the first lower plate and adjacent to the upper plate, wherein the upper plate and the first edge plate are separated by a gap; wherein the flooring edge finish is folded while moving through the feed section such that a first longitudinal section of the finishing strip is positioned between the first lower and upper plates, and a second longitudinal section of the finishing strip is positioned between the upper plate and the first edge plate; and an attachment section abutting the feed section comprising a second lower plate; a second edge plate; and one or more heating elements for heating the second lower plate and the second edge plate to adhere the flooring edge finish to bottom and edge surfaces of flooring simultaneously. The second lower plate and the second edge plate comprise polymer, carbon, metal, ceramic, glass, or a mixture thereof. The first edge plate has a shorter length than the first lower plate.

Figure 10:
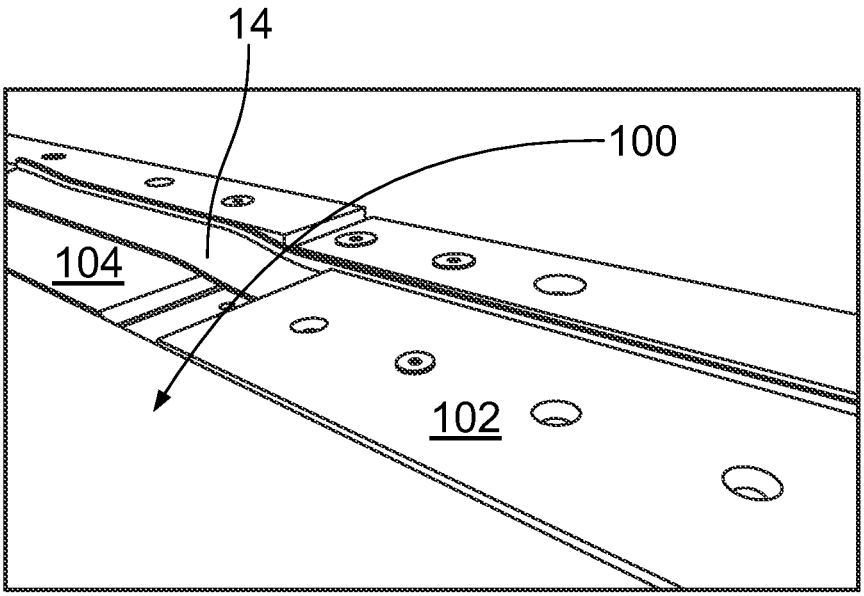
FIG. 10 is a photograph of a side view of a table-mounted flooring edge tool.
Figure 11:
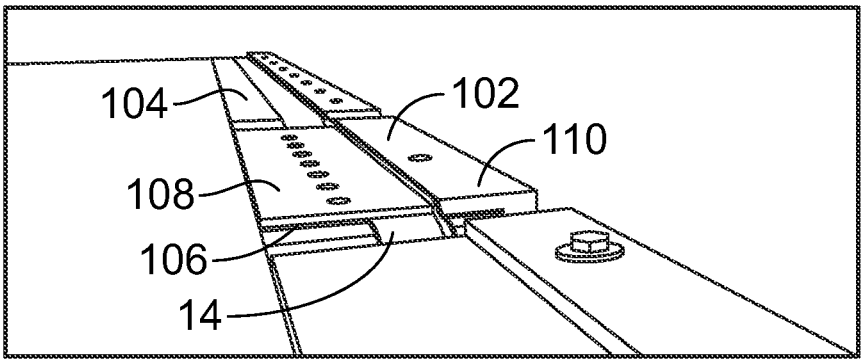
FIG. 11 is a photograph of a side view of a table-mounted flooring edge tool.
Figure 12:
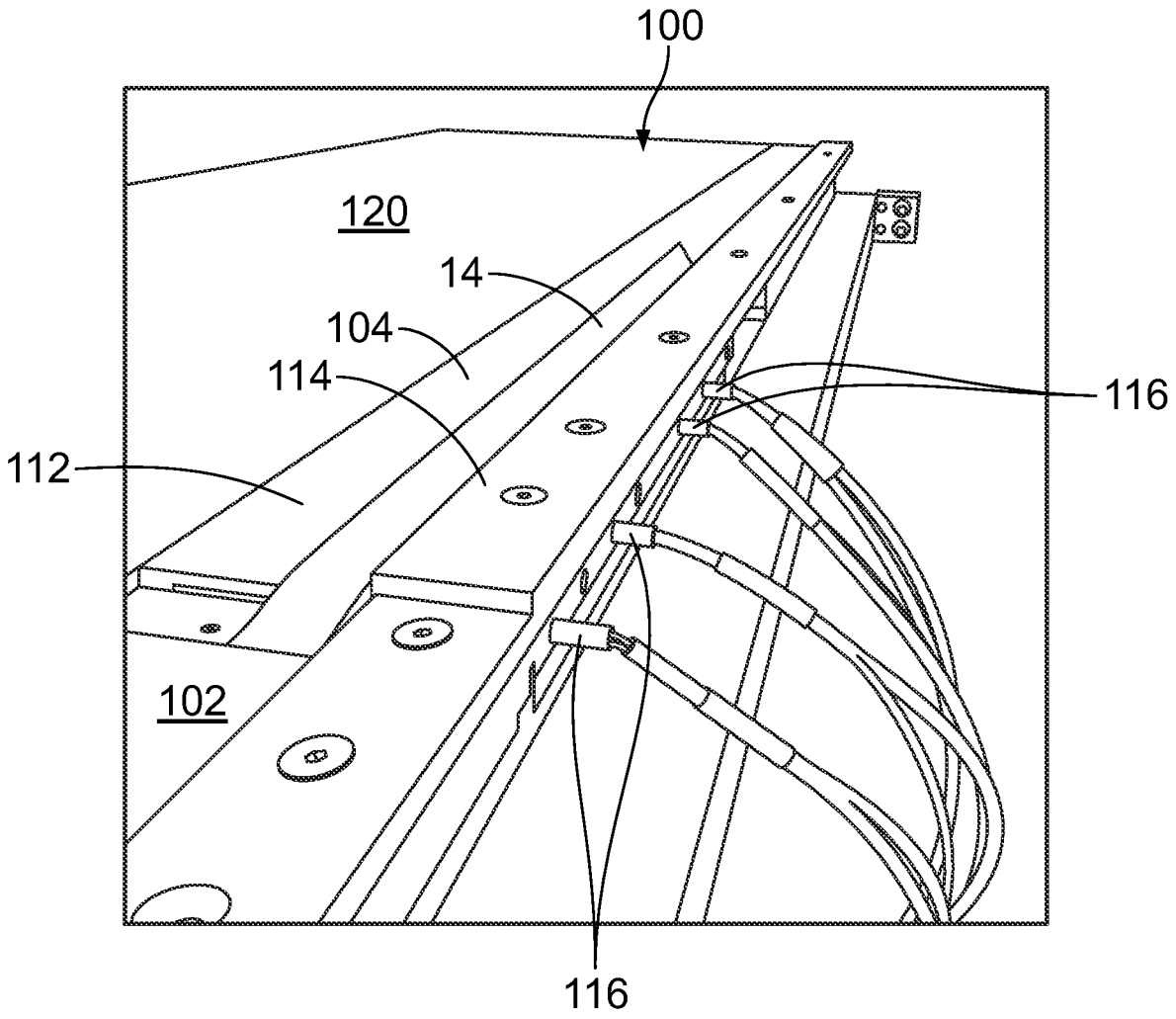
FIG. 12 is a photograph of a side view of a table-mounted flooring edge tool.

FIGS. 10-12 are photographs of different perspectives of a table mounted flooring edge tool. In embodiments, the table-mounted flooring edge tool 100 includes a feed section 102 and an attachment section 104. Feed section 102 includes a lower plate 106, an upper plate 108 and an edge plate 110. One longitudinal section of flooring edge finish 14 is sandwiched between lower plate 106 and the upper plate 108 while another longitudinal section is sandwiched between upper plate 108 and edge plate 110. In embodiments, upper plate 108 can have the same length as lower plate 106, or upper plate 108 can be shorter than lower plate 106 to assist movement of flooring edge finish 14 from feed section 102 to attachment section 104. The configuration of lower plate 106, upper plate 108 and edge plate 110 serves to bend flooring edge finish 14 along hinge 22. Flooring edge finish 14 enters one end of feed section 102 as shown in FIG. 11, and exits the other end of feed section 102 as shown in FIG. 10 in preparation for being applied to a flooring.

In embodiments, table-mounted flooring edge tool 100 includes an attachment section 104. Attachment section 104 generally abuts feed section 102 so that flooring can move smoothly in the process. In embodiments, attachment section 104 and feed section 102 are separated by a gap. Attachment section 104 includes a lower plate 112 and an edge plate 114. Lower plate 112 is generally co-planar with upper plate 108. Edge plate 114 is generally coplanar with edge plate 110. In embodiments, edge plate 114 can be thicker than edge plate 110 to accommodate the combined thickness of flooring edge finish 14 and flooring.

Attachment section 104 includes one or more heating elements 116, which can be used to heat lower plate 112 and edge plate 114 while applying flooring edge finish 14 to a flooring (not shown). Lower plate 112 and edge plate 114 can be fabricated of suitable rigid conductors of heat including, but not limited to, polymer, carbon, metal ceramic, glass, or mixtures thereof. The metal can be aluminum, copper, brass, steel, or bronze. The heat conductors are capable of being heated to a temperature of approximately 200-500 degrees F. The heating temperature can vary or can be constant. In embodiments, edge plate 114 can form an angle of approximately 90 degrees with lower plate 112. In other embodiments, edge plate 114 can form an angle between approximately 65 and 85 degrees with lower plate 112.

In embodiments, table-mounted flooring edge tool 100 can include a support section 120 for supporting a flooring while flooring edge finish 14 is being applied. In embodiments, edge plates 110 and 114 can have a thickness of approximately 0.1 to 1 inch. In embodiments, feed section 102 and attachment section 104 can have a length of approximately 6 inches up to entire length of flooring material edge.

FIG. 13 is a flowchart illustrating a method 130 of applying a flooring edge finish to flooring using the table-mounted flooring edge tool of FIGS. 10-12. In embodiments, method 130 includes at least one of steps 132, 134, 136 and 138, described below.

Figure 14:
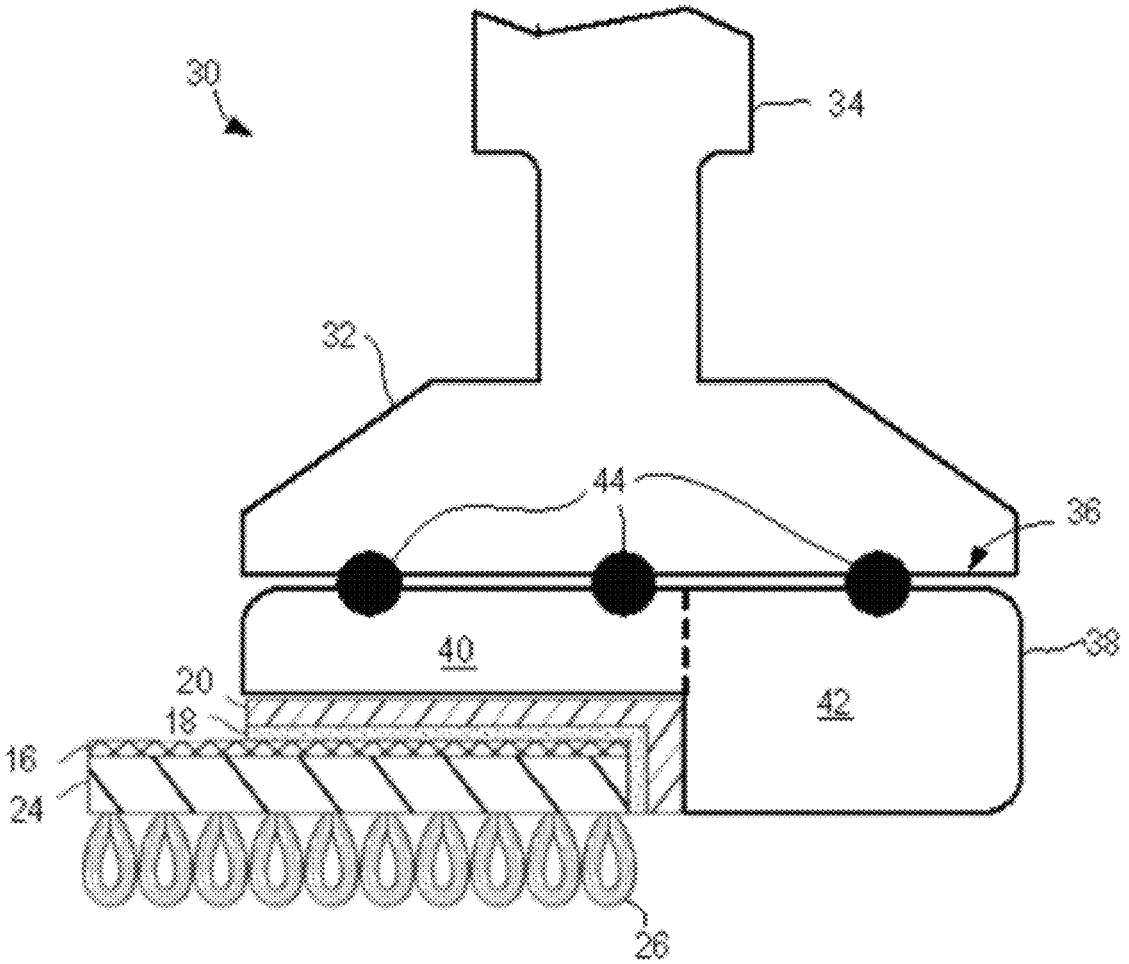
FIG. 14 is an end view of a hand-held flooring edge tool adjacent to a carpet and flooring edge finish after adhesion of the flooring edge finish to the carpet's raw edge.

FIG. 14 shows a view of the hand-held flooring tool 30 adjacent to an applied finishing strip 14 on an edge of a carpet 12. Shown is a side view 15 of carpet 12 and flooring edge finish 14 after flooring edge finish 14 has been adhered to a carpet 12. As in FIG. 1, carpet 12 has fibers 26 embedded into carpet backing 24 and an optional carpet pad 16 underneath the carpet backing 24. Flooring edge finish 14 has been folded upward approximately 90 degrees along the hinge 22 so that the adhesive 18 on longitudinal section 20 contacts carpet pad 16 and carpet backing 24. Flooring edge finish 14 binds and covers the carpet 12.

Also shown is an end view of a hand-held flooring edge tool 30. A main body 32 includes an upper extension 34, which can incorporate a handle or grasping surface (not shown). Main body 32 also includes a base 36 having a width Wi and a length L (not shown). In embodiments, length L would extend in a generally perpendicular direction from the end of base 36. A bi-level soleplate 38 is co-planar with and coupled to base 36. Bi-level soleplate 38 includes a first section 40 having a first thickness $T_1$, length L and a second width $W_2$, wherein the second width $W_2$ is less than the first width $W_1$. The bi-level soleplate includes a second section 42 having a second thickness $T_2$, length L and a third width $W_3$, wherein $T_2$ is greater than $T_1$ and $W_3$ is approximately equal to $W_1-W_2$. In another embodiment, the length L is greater than or equal to the width of the base $W_1$. First section 40 and second section 42 form an angle $A_1$. In embodiments, angle $A_1$ is approximately 65-95 degrees or, in another embodiment, about 90 degrees.

One or more heating elements 44 are incorporated in main body 32 in a position that brings them into contact with bi-level soleplate 38 for heating during application of a flooring edge finish 14 to flooring. Main body 32 also incorporates circuitry for controlling heating elements 44 and other components of hand-held flooring edge tool 30. While shown in mutual physical contact between the base 36 and bi-level soleplate 38, in an alternative embodiment, the heating elements 44 are embedded within the base 36 and are in thermal communication with the bi-level soleplate 38. The heating elements can be randomly or uniformly positioned.

Step 132 includes feeding a flooring edge finish 14 of FIG. 1 into feed section 102. In an example of step 132, flooring edge finish includes a longitudinal section including a hinge where the longitudinal section is placed along a bottom surface of the flooring and the other longitudinal section is placed along a side of the flooring. One longitudinal section is fed between lower plate 106 and upper plate 108 while the other longitudinal section is fed between upper plate 108 and edge plate 110.

Step 134 includes feeding a flooring along feed section 102. In an example of step 134, flooring travels along feed section 102 at the same rate that flooring edge finish 14 so that a leading edge of the flooring and flooring edge finish 14 meet as they leave feed section 102 and enter attachment section 104. Feed section 102 causes flooring edge finish 14 to be positioned along a bottom and edge of the flooring so that the flooring edge finish can be adhered to the flooring in attachment section 104.

Step 136 includes using attachment section 104 to apply heat, pressure or a combination thereof to the flooring edge finish. In an example of step 136, attachment section 104 is placed against both longitudinal sections simultaneously to adhere flooring edge finish 14 to the bottom and side surfaces of the flooring simultaneously.

Step 138, which is optional, includes using a heat gun to apply heat, pressure or a combination thereof to the flooring edge finish. In embodiments, step 138 is similar to step 76 of FIG. 7.

Alternative embodiments of the subject matter of this application will become apparent to one of ordinary skill in the art to which the present invention pertains, without departing from its spirit and scope. It is to be understood that no limitation with respect to specific embodiments shown here is intended or inferred.

We claim:

1. A flooring edge tool for applying a flooring edge finish to a flooring surface comprising:

a main body comprising a base having a length L and a first width $W_1$, and a handle or grasping surface;

a bi-level soleplate coplanar with and coupled to the base, the bi-level soleplate comprising:

a first section having a first thickness $T_1$, the length L and a second width $W_2$; and a second section having a second thickness $T_2$, the length L and a third width $W_3$, wherein $T_2$ is greater than $T_1$ and $W_3$ is approximately equal to $W_1$-$W_2$; and a heating element within the main body for heating the bi-level soleplate.

2. The flooring edge tool of claim 1, wherein the flooring edge tool can adhere the flooring edge finish to a bottom and an edge of the flooring simultaneously.

3. The flooring edge tool of claim 1, wherein a surface of the first section opposite the base and a side of the second section form an angle of approximately 65 to 85 degrees.

4. The flooring edge tool of claim 1, wherein a surface of the first section opposite the base and a side of the second section form an angle of approximately 90 degrees.

5. The flooring edge tool of claim 1, wherein the heating element comprises a plurality of heating elements.

6. The flooring edge tool of claim 1, wherein the bi-level soleplate is capable of being heated to a temperature of approximately 200-500 degrees F.

7. The flooring edge tool of claim 1, wherein a total width of the bi-level soleplate ($W_2$+$W_3$) is less than the width of the base ($W_1$).

8. The flooring edge tool of claim 1, wherein the heating element comprises a plurality of heating elements spaced across the bi-level soleplate.

9. The flooring edge tool of claim 1, wherein the second width $W_2$ is greater than, less than, or equal to the third width $W_3$.

10. The flooring edge tool of claim 1, wherein the length L is less than, greater than, or equal to the width of the base $W_1$.

11. The flooring edge tool of claim 1, wherein the bi-level soleplate comprises polymer, carbon, metal, ceramic, glass, or a mixture thereof.

12. The flooring edge tool of claim 1, wherein the base comprises a first base section and a second base section wherein the second base section extends away from the base alona lenath L.

* * * * *